US005507401A

United States Patent [19]

Huang

[11] Patent Number: 5,507,401

[45] Date of Patent: Apr. 16, 1996

[54] PERSONAL PERFUME CARRIER

[76] Inventor: Yu-Hwei Huang, 1F, No. 5, Alley 2, Lane 85, Min Tsu Rd., Lu Chou Hsiang, Taipei Hsien, Taiwan

[21] Appl. No.: 304,505

[22] Filed: Sep. 12, 1994

[51] Int. Cl.[6] ..... B65D 23/02

[52] U.S. Cl. ..... 215/12.1; 215/228; 215/341; 215/354; 401/128

[58] Field of Search ..... 215/228, 231, 215/341, 343, 354, 12.1; D7/511; 220/408, 410, 409; 401/122, 128, 54

[56] References Cited

U.S. PATENT DOCUMENTS

| | | | |
|---|---|---|---|
| 934,344 | 9/1909 | Parker | 215/12.1 |
| 1,188,132 | 6/1916 | Anderson | 215/12.1 X |
| 2,623,229 | 12/1952 | Brinton | 401/128 |
| 2,944,690 | 7/1960 | Darmstadt | 215/354 X |
| 3,147,511 | 9/1964 | Pittoni | 401/128 |
| 3,363,635 | 1/1968 | Wurmbock | 401/128 X |
| 4,163,517 | 8/1979 | Kappler et al. | 229/4.5 |
| 4,800,156 | 1/1989 | Yuhda | 215/354 X |
| 5,167,929 | 12/1992 | Korf et al. | 220/410 |

FOREIGN PATENT DOCUMENTS 2237307 2/1974 Germany .

*Primary Examiner*—Allan N. Shoap
*Assistant Examiner*—Christopher J. McDonald
*Attorney, Agent, or Firm*—Ostrolenk, Faber, Gerb & Soffen

[57] ABSTRACT

A perfume carrier including a casing made of impact resisting material and defining a holding chamber, a compression spring received inside the holding chamber, a perfume bottle received in the holding chamber and supported on the compression spring, and a bottle cap detachably fastened to the casing through a screw joint to seal the perfume bottle and having a perfume application rod, which is inserted into the perfume bottle when the bottle cap is fastened to the casing.

7 Claims, 6 Drawing Sheets

PERSONAL PERFUME CARRIER

BACKGROUND OF THE INVENTION

The present invention relates to a personal perfume carrier for carrying perfumes, and relates more particularly to a keyring holder type perfume carrier for carrying a bunch of keys as well as perfumes.

Before going outside or participating in a party, women tend to spray a perfume around their neck or ears. However, the perfume will change into vapor quickly when it is exposed to the air. Because regular perfume bottles are commonly made of glass, they may be broken easily. Therefore, people tend to spray the body with perfume indoors and don't like to carry perfume bottles as personal items.

SUMMARY OF THE INVENTION

The present invention has been accomplished under the circumstances in view. It is therefore the principal object of the present invention to provide a perfume carrier which is convenient for carrying a perfume bottle as a personal item. It is another object of the present invention to provide a perfume carrier which protects a perfume bottle against damage. According to one embodiment of the present invention, the perfume carrier comprises a casing to hold a perfume bottle, and a bottle cap fastened to the casing through a screw joint to seal the perfume bottle. The bottle cap has a perfume application rod, which is inserted into the perfume bottle when the bottle cap is fastened to the casing, and a conical packing rubber for sealing the perfume bottle to prevent the perfume from changing into vapor.

DETAILED DESCRIPTION OF THE PREFERRED EMBODIMENTS.

Figure 1:
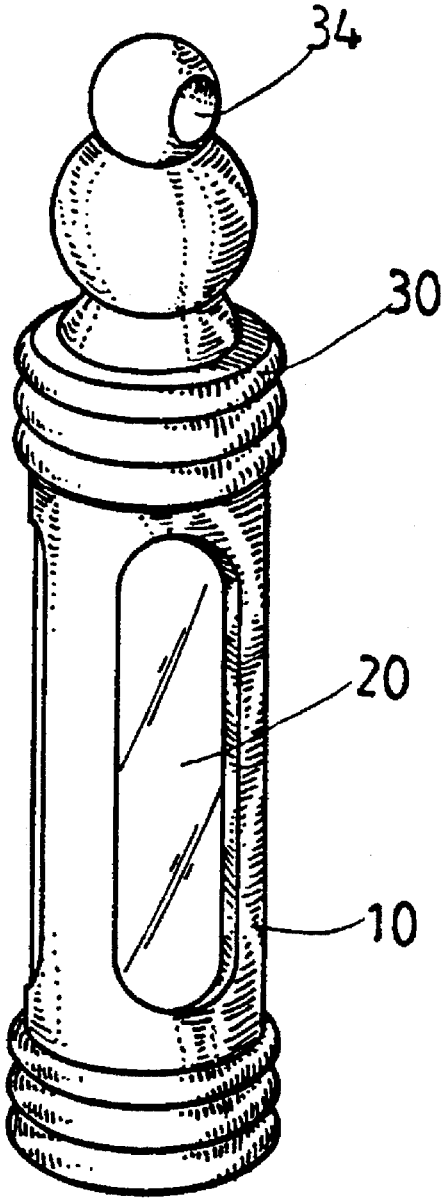
FIG. 1 is a perspective of a perfume carrier according to one embodiment of the present invention.

Referring to FIG. 1, a perfume carrier according to one embodiment of the present invention is comprised of a casing 10, a transparent perfume bottle 20 received in the casing 10, and a bottle cap 30 coupled to the perfume bottle 20.

Figure 2:
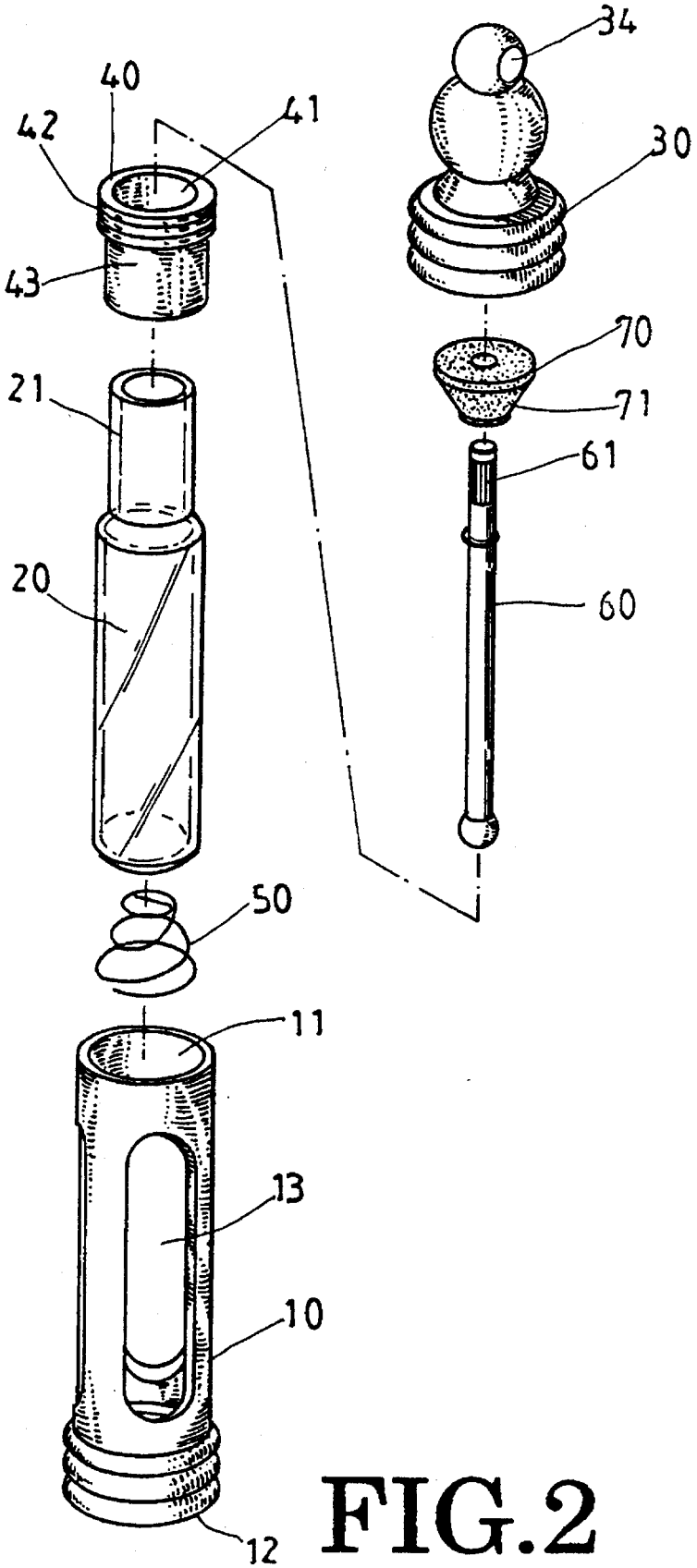
FIG. 2 is an exploded perspective of the perfume carrier shown in FIG. 1.
Figure 3:
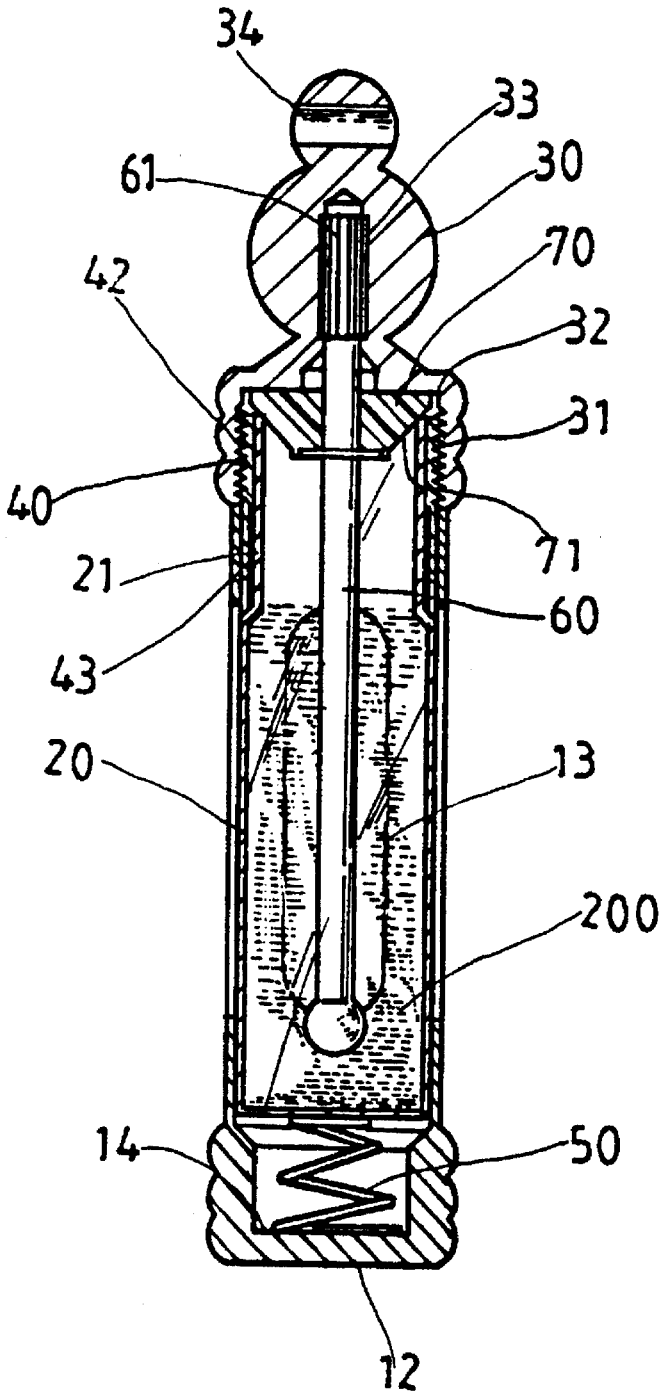
FIG. 3 is a longitudinal view in section of FIG. 2.

Referring to FIGS. 2 and 3 and FIG. 1 again, the casing 10 is made from metal or any suitable material of high impact strength, defining a holding chamber 11 for holding the perfume bottle 20. The casing 10 has a closed bottom end 12, and a plurality of longitudinal slots 13 through the peripheral wall in communication with the holding chamber 11. The perfume bottle 20 is preferably made from glass, having a neck 21 at the top. A spring 50 is received inside the holding chamber 11 to support the perfume bottle 20. A stopper 40 is inserted into the holding chamber 11 and mounted around the neck 21 of the perfume bottle 20 to hold down the perfume bottle 20. The stopper 40 comprises a center through hole 41, an outer thread 42, and a stopper tube section 43. The outer diameter of the stopper tube section 43 is approximately equal to the diameter of the holding chamber 11. The diameter of the center through hole 41 is approximately equal to the outer diameter of the neck 21 of the perfume bottle 20. When the stopper tube section 43 of the stopper 40 is inserted into the holding chamber 11 of the casing 10, the outer thread 42 of the stopper 40 is stopped above the topmost edge of the casing 10 outside the holding chamber 11, and the neck 21 of the perfume bottle 20 fits into the center through hole 41. The bottle cap 30 comprises a screw hole 31 at the bottom for threading onto the outer thread 42 of the stopper 40, an eye 34 at the top for carrying a keyring or the like, and a longitudinal mounting hole 33 within the screw hole 31. A application rod 60 is provided having a coupling end 61 fitted into the longitudinal mounting hole 33. A conical packing rubber 70 is mounted around the application rod 60 and disposed inside the screw hole 31. The outer diameter 71 of the conical packing rubber 70 gradually reduces toward the bottom (in the direction reverse to the eye 34).

Referring to FIG. 3 again, when the bottle cap 30 is fastened to the outer thread 42 of the stop member 40, the conical packing rubber 70 is partially forced into the neck 21 of the perfume bottle 20 to stop the perfume 200 of the perfume bottle 20 from changing into vapor.

Figure 4:
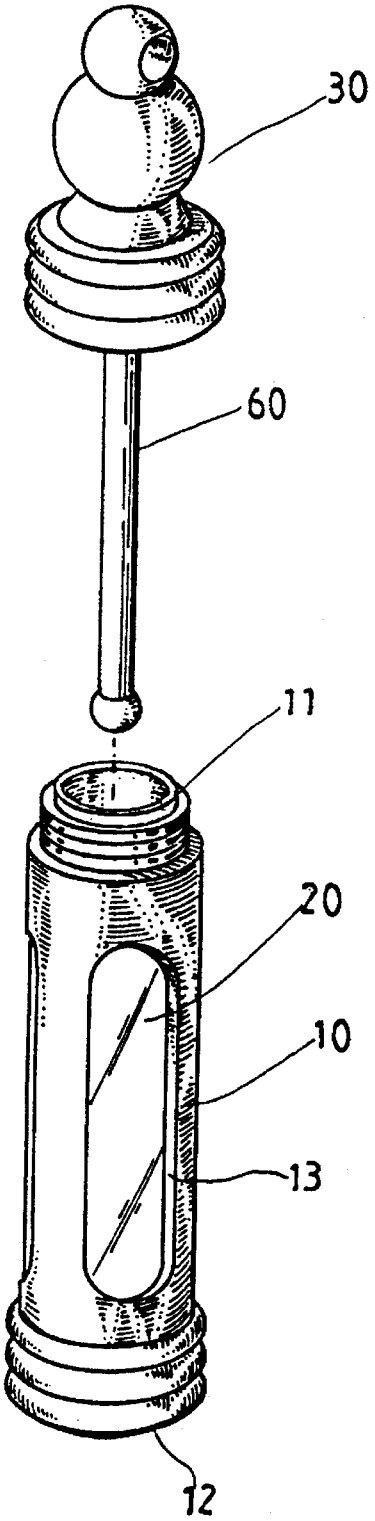
FIG. 4 is a perspective illustrating the perfume carrier of FIG. 1 opened.

Referring to FIG. 4, when the bottle cap 30 is disconnected from the stop member 40, the application rod 60 is simultaneously carried out of the perfume bottle 20 by the bottle cap 30 for applying the perfume 20 to the skin.

Figure 5:
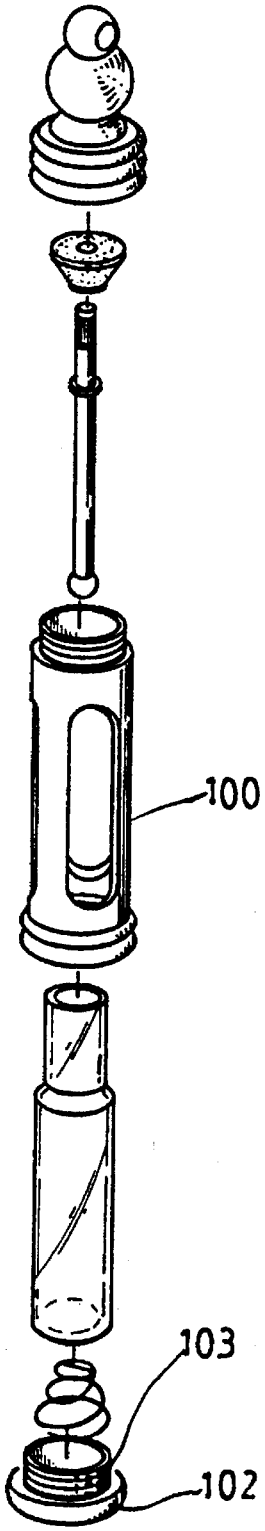
FIG. 5 is an exploded perspective of a perfume carrier according to an alternate form of the present invention.
Figure 6:
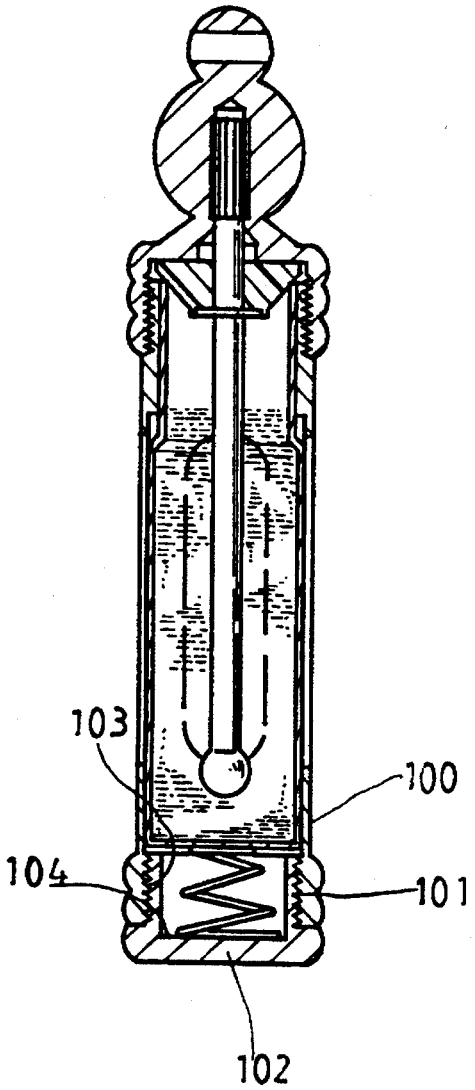
FIG. 6 is a longitudinal view in section of the perfume carrier of FIG. 5.

FIGS. 5 and 6 show an alternate form of the casing. The casing, referenced by 100, has a screw hole 101 on the bottom end thereof and detachably sealed by an end cap 102. The end cap 102 has female screw 103 threaded into the screw hole 101 of the casing 100 and a spring seat 104 inside the screw hole 101 for holding the aforesaid spring 50.

Figure 7:
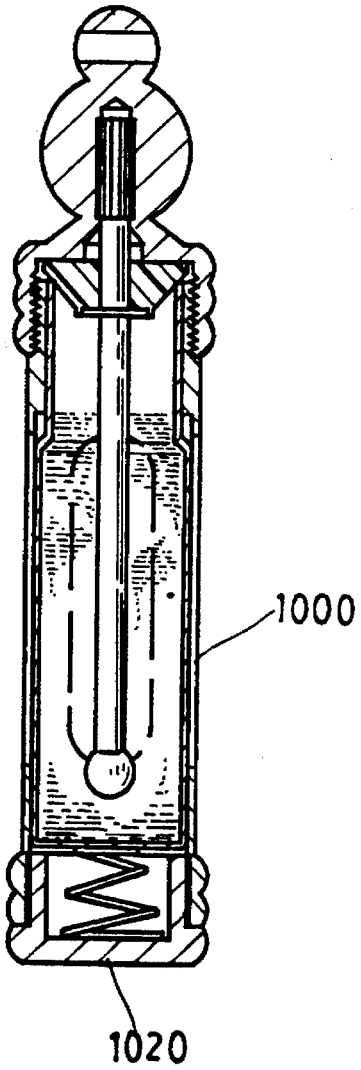
FIG. 7 is a longitudinal view in section of another alternate form of the present invention.

FIG. 7 shows another alternate form of the casing. The casing, referenced by 1000, has an open bottom end sealed by an end cap 1020. The end cap 1020 is fastened to the casing 1000 by plugging.

Because the casing of the perfume carrier is impact resisting, the perfume bottle will not be damaged. By means of the eye 34 on the bottle cap 36, the perfume carrier can be fastened to a personal item such as key chain, keyring holder, purse, etc.

What is claimed is:

1. A perfume carrier comprising:

a casing made of impact resisting material, comprising a peripheral wall, a holding chamber defined within said peripheral wall, and a top opening communicated with said holding chamber;

a spring received inside said holding chamber;

a perfume bottle received in said holding chamber and supported on said spring which is disposed below said bottle and urges said bottle upward with respect to said casing;

a bottle cap detachably fastened at said top opening of said casing through a screw joint to seal said perfume bottle, said bottle cap having a perfume application rod, which is inserted into said perfume bottle when said bottle cap is fastened to said casing, a cushion mounted around said perfume application rod and axially fixed on said rod for sealingly engaging said perfume bottle;

a stopper at said top opening, said stopper being disposed around a smooth neck on said perfume bottle to hold down said perfume bottle in said holding chamber, said screw joint comprising an external thread on said stopper in operative engagement with an internal thread on said bottle cap.

2. The perfume carrier of claim 1 wherein said casing has a plurality of longitudinal slots through said peripheral wall.

3. The perfume carrier of claim 1 wherein said casing further comprises a bottom wall covered over a bottom end of said holding chamber to hold said spring inside said holding chamber.

4. The perfume carrier of claim 1 wherein said casing further comprises an open bottom end sealed by an end cap, said end cap being fastened to the open bottom end of said casing through a screw joint.

5. The perfume carrier of claim 1 wherein said casing further comprises an open bottom end sealed by an end cap, said end cap being fastened to the open bottom end of said casing by plugging.

6. The perfume carrier of claim 1 also comprising a formation exclusive of said spring to limit downward movement of said perfume bottle in said chamber to a location substantially above the bottom of said chamber, said formation being disposed in the vicinity of the bottom of said perfume bottle.

7. The perfume container of claim 6 in which the formation exclusive of said spring is integral with said peripheral wall.

* * * * *